US007279652B2

(12) United States Patent
Genz et al.

(10) Patent No.: US 7,279,652 B2
(45) Date of Patent: Oct. 9, 2007

(54) PUSH BUTTON SWITCH ASSEMBLY

(75) Inventors: Earl Genz, Des Plaines, IL (US); Julie Rutkowski, Chicago, IL (US); Brian Truesdale, Wauconda, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 11/489,346

(22) Filed: Jul. 19, 2006

(65) Prior Publication Data

US 2007/0102275 A1 May 10, 2007

Related U.S. Application Data

(60) Provisional application No. 60/735,038, filed on Nov. 9, 2005.

(51) Int. Cl.
*H01H 5/30* (2006.01)

(52) U.S. Cl. ..... 200/406

(58) Field of Classification Search ..... 200/406, 200/516, 302.1, 302.2
See application file for complete search history.

(56) References Cited

U.S. PATENT DOCUMENTS 4,163,125 A * 7/1979 Boulanger ..... 200/5 A
4,352,968 A * 10/1982 Pounds ..... 200/302.2
4,398,074 A * 8/1983 Danielson et al. ..... 200/302.2
4,421,966 A * 12/1983 Pounds ..... 200/309
4,924,046 A * 5/1990 Howard ..... 200/516
5,939,690 A * 8/1999 Yasui et al. ..... 200/302.2
6,382,809 B1 * 5/2002 Ou-Yang ..... 200/511
6,501,036 B2 * 12/2002 Rochon et al. ..... 200/302.2
6,626,473 B1 * 9/2003 Klein et al. ..... 200/302.2
6,646,217 B2 * 11/2003 Omata ..... 200/406
6,768,070 B2 7/2004 Lewison et al.

* cited by examiner

*Primary Examiner*—Michael A Friedhofer
(74) *Attorney, Agent, or Firm*—Mark W. Croll; Paul F. Donovan

(57) ABSTRACT

A switch assembly includes a unitary push button housing including an actuable button, a retainer having a first surface and a second surface, in which the retainer is secured within the push button housing, a snap dome secured on the first surface of the retainer, and at least one terminal passing through the second surface of the retainer to the first surface. The button is configured to be actuated into the snap dome, so that the snap dome is urged into contact with the terminal.

15 Claims, 2 Drawing Sheets

PUSH BUTTON SWITCH ASSEMBLY

RELATED APPLICATIONS

This application relates to and claims priority benefits from U.S. Provisional Patent Application No. 60/735,038 entitled "Push Button Switch," filed Nov. 9, 2005, which is hereby incorporated by reference in its entirety.

FIELD OF THE INVENTION

Embodiments of the present invention generally relate to switches, and more particularly to push button switches.

BACKGROUND OF THE INVENTION

Push button switches are used in various applications, such as with marine equipment, medical equipment, outdoor controls, food processing equipment, appliances, recreational vehicles, and the like. Typically, the switches include a button that is engaged to contact a circuit in order to activate or deactivate a particular application.

U.S. Pat. No. 6,768,070, issued to Lewison et al. (the "Lewison patent") discloses a switch that includes an elastomeric body having a recess that receives a printed circuit board. The external periphery of the printed circuit board engages an internal groove to form a closed switch cavity between the printed circuit board and one end of the elastomeric body.

The switch disclosed in the Lewison patent, however, includes a number of distinct parts. For example, the printed circuit board is retained within the switch, and is connected to a series of electrical wires. During the manufacturing process, the printed circuit board is carefully positioned within the switch in order to provide a functional switch. Moreover, care is used to ensure that the printed circuit board and associated wires are not damaged during the manufacturing process. Further, after the switch is assembled and in use, the printed circuit board may malfunction or it may operate less efficiently over time.

Thus, a need exists for a simpler, more reliable push button switch.

SUMMARY OF THE INVENTION

Certain embodiments of the present invention provide a switch assembly configured to be secured to a panel. The switch assembly includes an integrally formed push button housing that includes a button, which may be formed of silicone, and a circumferential sheath, which may be formed of rubber, positioned around the button.

The switch assembly may also include a retainer, such as disk, wafer, chip, board, or the like, having a first surface and a second surface. The retainer may be secured within the push button housing.

The switch assembly may also include a snap dome, which may be metallic, secured on the first surface of said retaining disk. Terminals pass through the second surface of the retainer to the first surface. At least one epoxy sealing layer may be formed between each terminal and the retaining disk.

The button is configured to be actuated into the dome, such that the dome is urged into contact with the terminal. During this movement, the dome may produce or otherwise emit an audible sound, such as a click or snap, that indicates that the switch has been fully engaged.

Figure 1:
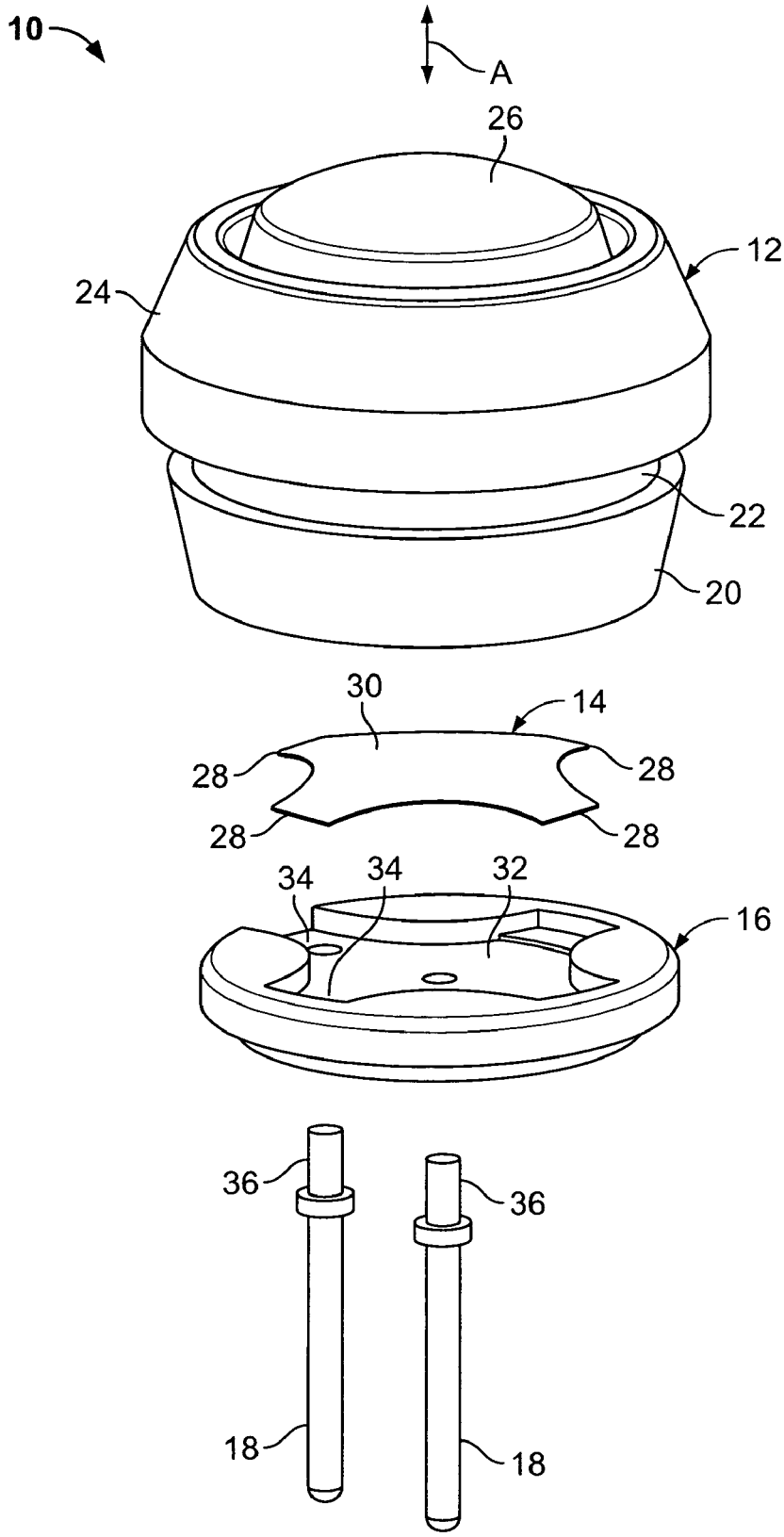
FIG. 1 illustrates an isometric exploded view of a push button switch assembly according to an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 illustrates an isometric exploded view of a push button switch assembly 10 according to an embodiment of the present invention. The push button switch assembly 10 includes a push button housing 12, a snap dome 14, a retaining disk 16, and two terminals 18.

The push button housing 12 is single unit that may be formed of an elastomeric material. That is, all the components of the push button housing 12 are integrally formed or molded as a single piece. The elastomeric push button housing 12 provides a sealed environment that protects the internal components from moisture infiltration.

The push button housing 12 includes a base 20 having an annular notch 22 formed proximate a circumferential sheath 24. The sheath 24 surrounds a circumference of a semi-spherical button 26. The button 26 is configured to move relative to the sheath 24 through the directions noted by arrow A. The notch 22 is configured to be received and retained by a panel or other such structure, such that the push button assembly 10 may be securely retained within the panel. For example, an instrument panel may include an opening that receives the push button assembly 10. The notch 22 snapably engages edges defining the opening so that the push button assembly 10 may be secured therein.

The push button housing 12 may be molded as a one piece elastomer. For example, a two-shot molding process may be used so that the button 26 is formed of a first material having a first color, and the remainder of the push button housing 12 is a second material having a second color. The button 26 may be a different material and/or color than the remainder of the push button housing 12 so a user can easily identify the button 26. Further, the button 26 may be silicone, while the remainder of the push button housing 12 is rubber or another such elastomeric material.

Figure 3:
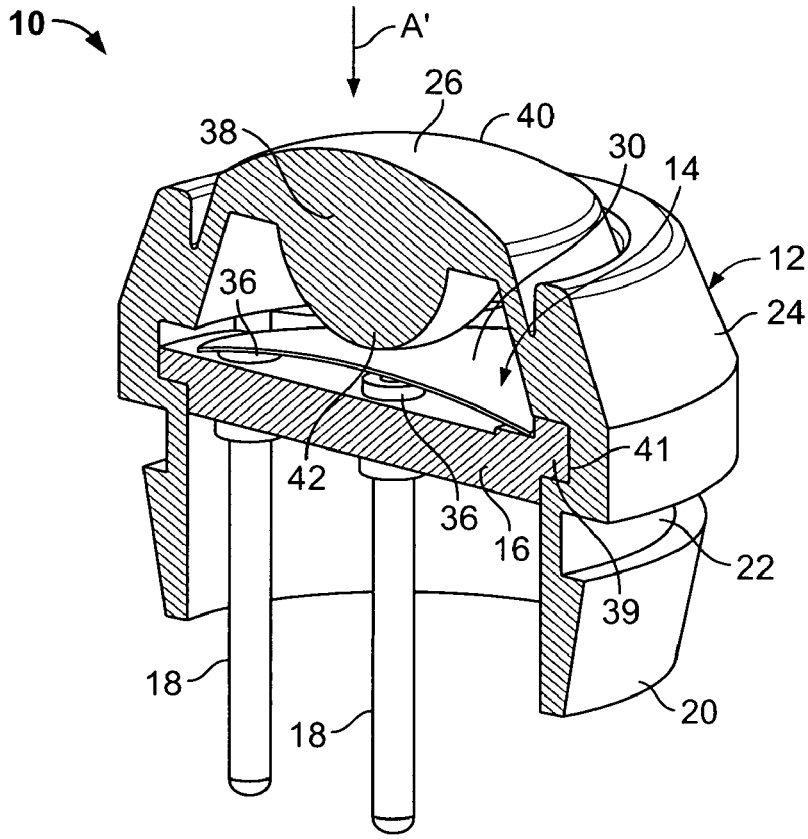
FIG. 3 illustrates a transverse cross-sectional view of a push button switch assembly according to an embodiment of the present invention.

The push button switch assembly 10 may be fully sealed through epoxy materials. For example, the base 20 may be sealed to a panel by way of a layer of epoxy material that sealingly engages the interface between the base 20 and the panel. With reference to FIG. 3, the cavity housing the terminals 18 and surrounded by the disk 16 and base 20 may be filled with epoxy sealant. Moreover, the elastomeric or rubber base 20 can provide a sufficient seal between the base 20 and the panel.

The snap dome 14 may be a unitary metal piece that includes arms 28 integrally connected to a dome 30 that spans between the arms 28. The arms 28 are configured to outwardly flex or bow the dome 30. The snap dome 14 is configured to be actuated in the directions of arrow A, and produce an audible snap or click sound when actuated. While the snap dome 14 is shown having four arms 28, the snap dome 14 may include more or less arms 28 than those shown. Alternatively, the snap dome 14 may not include defined arms, but, instead, may resemble a conventional semi-spherical dome.

The interaction between the button 26 and the snap dome 30 provides a tactile feel. The snap dome 14 is retained within the retaining disk 16. The retaining disk 16 includes a recessed area 32 configured to receive and retain the snap dome 14. For example, the recessed area 32 includes arm areas 34 in which the arms 28 of the snap disk are positioned. The retaining disk 16 also includes terminal through holes configured to receive and retain terminal contact ends 36 of the terminals 18. The terminal contact ends 36 are positioned below the dome 30 within the retaining disk 16 (see FIG. 3). Thus, the dome 30 may be actuated toward the terminals 18 in order to engage the terminal contact ends 36.

Figure 2:
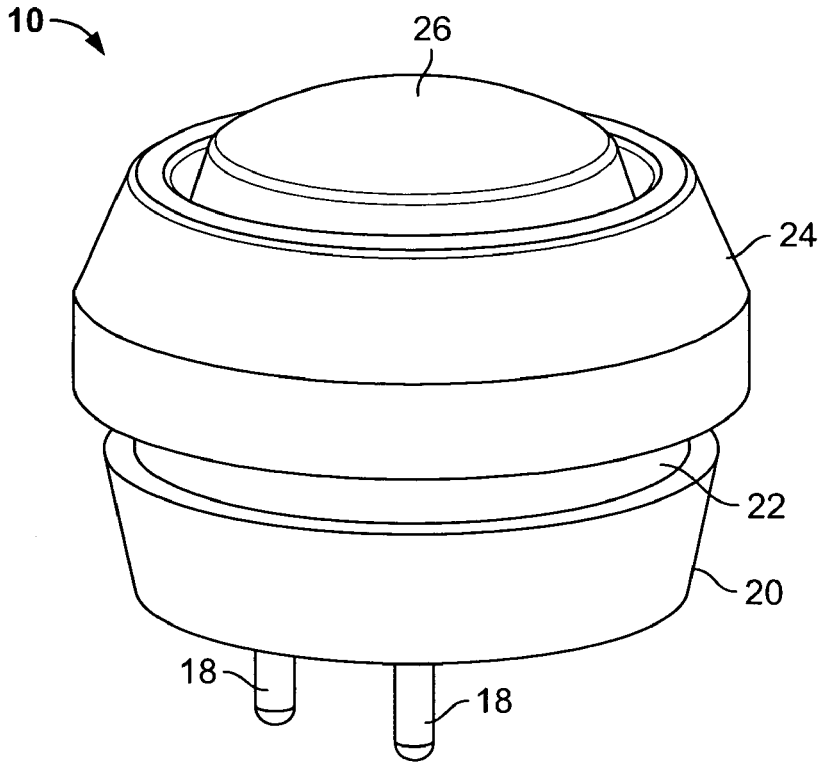
FIG. 2 illustrates an isometric view of a push button switch assembly according to an embodiment of the present invention.

FIG. 2 illustrates an isometric view of the push button switch assembly 10, while FIG. 3 illustrates a transverse cross-sectional view of the push button switch assembly 10. As discussed above, the push button switch assembly 10 is secured into a panel, wall, board, or the like, by way of the notch 22 snapably engaging a reciprocal structure, such as an edge that defines an opening within the panel, wall, or board. As shown in FIG. 3, in particular, the base 20, notch 22, sheath 24, and the button 26 of the push button housing 12 are of a unitary construction. That is, the push button housing 12 is integrally formed or manufactured as a single piece.

Referring to FIG. 3, a circumferential edge 39 of the retaining disk 16 is secured within a reciprocal groove 41 formed within the push button housing 12, above the notch 22. The push button 26 includes a protrusion 38 downwardly extending from an engageable end 40 of the push button 26. The protrusion 38 is positioned over the dome 30 of the snap dome 14. In an at-rest position, a gap may exist between the distal end 42 of the protrusion 38, and the dome 30. Alternatively, in an at-rest position, the distal end 42 of the protrusion 38 may come into contact with the dome 30, but without exerting any appreciable force thereon.

In operation, a user pushes the button 26 in the direction of arrow A' in order to activate or deactivate a particular component operatively connected to the push button switch assembly 10. As the button 26 moves in the direction of A', the protrusion 38 engages the dome 30. As the button 26 continues to move in the direction of arrow A', the dome 30 is forced in the direction of arrow A', thereby emitting a snapping or clicking sound that indicates that the button 26 has activated or deactivated a particular component. A bottom surface of the dome 30 contacts the terminal contact ends 36, thereby completing a circuit between the two terminals 18. As such, the push button switch assembly 10 switches a component into an activated or deactivated state, depending on the application.

When force is no longer applied to the push button 26, the snap dome 14 snaps back to its at-rest position, thereby breaking contact with the terminal contact ends 36. Similarly, the resilient button 26 returns to its at-rest position between the dome 30 and the protrusion 38.

Thus, embodiments of the present invention provide a simpler, more reliable push button switch. The push button switch assembly shown and described uses a small number of parts, and does not include an internal printed circuit board that may be damaged during manufacture and/or use. Because the push button switch assembly uses a small number of simple parts, the cost of manufacturing is less than previous switch assemblies.

While various spatial terms, such as upper, lower, mid, lateral, horizontal, vertical, and the like may used to describe portions of the push button switch assembly, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A switch assembly comprising:

a unitary push button housing comprising an actuable button;

a one-piece retainer having an outer edge, first surface and a second surface, said retainer including a recessed area formed on said first surface, said retainer being secured within said push button housing;

a snap dome secured on said first surface of said retainer, such that said recessed area receives and retains said snap dome; and at least one terminal passing through said second surface of said retainer to said first surface, said button configured to be actuated into said snap dome, said snap dome being urged into contact with said at least one terminal when said button is actuated into said snap dome, wherein said snap dome includes a plurality of arms, and said recessed area of said retainer includes a plurality of arm areas in which said arms of said snap dome are respectively positioned, with one of said plurality of arm areas extending through said outer edge of said retainer providing an opening therethrough.

2. The switch assembly of claim 1, wherein said unitary push button housing is formed of an elastomeric material.

3. The switch assembly of claim 1, wherein said unitary push button housing further comprises an annular notch configured to receive and retain an edge of a structure.

4. The switch assembly of claim 1, further comprising at least one epoxy layer positioned at an interface of said at least one terminal and said retainer.

5. The switch assembly of claim 1, wherein said unitary push button housing further comprises a circumferential sheath positioned around said button.

6. The switch assembly of claim 5, wherein said button is a first color and said sheath is a second color.

7. The switch assembly of claim 1, wherein said snap dome produces an audible snap when urged into contact with said at least one terminal.

8. A switch assembly configured to be secured to a panel, the switch assembly comprising:

an elastomeric push button housing comprising an actuable button;

a one-piece retaining disk having an outer edge, a first surface and a second surface, said retaining disk including a recessed area formed on said first surface, said retaining disk being secured with said push button housing;

a dome secured on said first surface of said retaining disk, such that said recessed area receives and retains said dome; and first and second terminals passing through said second surface of said retaining disk to said first surface, said button configured to be actuated into said dome, said dome being in constant contact with said at least one terminal when said button is actuated into said dome, said dome emitting an audible sound when urged into contact with said at least one terminal.

wherein said dome includes a plurality of arms, and said retaining disk includes a plurality of arm areas in which said arms of said dome are respectively positioned, with one of said plurality of arm areas extending through said outer edge of said retaining disk providing an opening therethough.

9. The switch assembly of claim 8, wherein said push button housing further comprises an annular notch configured to receive and retain a portion of the panel.

10. The switch assembly of claim 8, further comprising at least one epoxy layer positioned at an interface of said at least one terminal and said retaining member.

11. The switch assembly of claim 8, wherein said push button housing further comprises a circumferential sheath positioned around said button.

12. The switch assembly of claim 11, wherein said button is a first material having a first color and said sheath is a second material having a second color.

13. A switch assembly configured to be secured to a panel, the switch assembly comprising:

an integrally formed push button housing comprising a silicone button, and a circumferential rubber sheath positioned around said button;

a one-piece retaining disk having an outer edge, a first surface and a second surface, said retaining disk including a recessed area formed on said first surface, said retaining disk being secured within said push button housing;

a metallic snap dome secured on said first surface of said retaining disk, such that said recessed area receives and retains said dome;

first and second terminals passing through said second surface of said retaining disk to said first surface, and at least one epoxy sealing layer between each of said terminals and said retaining disk;

said button configured to be actuated into said snap dome, said snap dome being in constant contact with said first terminal and is urgedinto contact with said second terminal when said button is actuated into said snap dome, said snap dome emitting an audible sound when urged into contact with said at least one terminal, Wherein said snap dome includes a plurality of arms, and said recessed area of said retaining disk includes a plurality of arm areas in which said arms of said snap dome are respectivelt positioned, with one of said plurality of arm areas extending through said outer edge of said retaining disk providing an opening therethrough.

14. The switch assembly of claim 13, wherein said push button housing further comprises an annular notch configured to receive and retain a portion of the panel.

15. The switch assembly of claim 13, wherein said button is a first material having a first color and said sheath is a second material having a second color.

* * * * *